US007931499B2

(12) United States Patent
Islam

(10) Patent No.: US 7,931,499 B2
(45) Date of Patent: Apr. 26, 2011

(54) CONNECTOR INCLUDING FLEXIBLE FINGERS AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 93 days.

(21) Appl. No.: 12/361,241

(22) Filed: Jan. 28, 2009

(65) Prior Publication Data

US 2010/0190377 A1 Jul. 29, 2010

(51) Int. Cl.
*H01R 9/05* (2006.01)

(52) U.S. Cl. ..... 439/584

(58) Field of Classification Search ..... 439/578–581, 439/271, 63, 584, 585
See application file for complete search history.

(56) References Cited

U.S. PATENT DOCUMENTS

| | | | | |
|---|---|---|---|---|
| 3,040,288 | A | 6/1962 | Edlen et al. | |
| 3,103,548 | A | 9/1963 | Concelman | 174/89 |
| 3,106,599 | A | 10/1963 | Leitner et al. | 174/12 |
| 3,671,926 | A | 6/1972 | Nepovim | |
| 3,744,011 | A | 7/1973 | Blanchenot | |
| 3,757,279 | A | 9/1973 | Winston | |
| 3,761,870 | A | 9/1973 | Drezin et al. | |
| 3,847,463 | A | 11/1974 | Hayward et al. | |
| 3,915,539 | A | 10/1975 | Collins | |
| 4,046,451 | A | 9/1977 | Juds et al. | |
| 4,491,685 | A | 1/1985 | Drew et al. | 174/75 C |
| 4,557,546 | A | 12/1985 | Dreyer | |
| 4,585,289 | A | 4/1986 | Bocher | |
| 4,676,577 | A | 6/1987 | Szegda | 439/584 |
| 4,915,651 | A | 4/1990 | Bout | 439/578 |
| 4,923,412 | A | 5/1990 | Morris | 439/578 |
| 4,979,911 | A | 12/1990 | Spencer | 439/583 |
| 5,137,470 | A | 8/1992 | Doles | 439/578 |
| 5,154,636 | A | 10/1992 | Vaccaro et al. | 439/583 |
| 5,267,877 | A | 12/1993 | Scannelli et al. | 439/584 |
| 5,281,167 | A | 1/1994 | Le et al. | 439/578 |
| 5,352,127 | A | 10/1994 | Muller et al. | 439/188 |
| 5,352,134 | A | 10/1994 | Jacobsen et al. | 439/584 |
| 5,509,821 | A | 4/1996 | Small et al. | 439/272 |
| 5,545,059 | A | 8/1996 | Nelson | 439/583 |

(Continued)

FOREIGN PATENT DOCUMENTS

DE 9400943 4/1994

(Continued)

OTHER PUBLICATIONS

U.S. Appl. No. 12/277,103, filed Nov. 24, 2008, Islam.

(Continued)

*Primary Examiner* — Javaid Nasri
(74) *Attorney, Agent, or Firm* — Allen, Dyer, Doppelt, Milbrath & Gilchrist, P.A.

(57) ABSTRACT

A coaxial cable connector is to be attached to a coaxial cable including an inner conductor, an outer conductor, and a dielectric therebetween. The coaxial cable connector includes a connector housing defining a ramp to receive an outer conductor thereagainst. A back nut has a ring base and a plurality of flexible fingers carried thereby to clamp against the outer conductor opposite the ramp. The connector housing and the back nut include respective portions defining a positive stop when fully engaged. A center contact is to be coupled to the inner conductor. There is at least one insulator member in the connector housing for carrying the center contact and comprising a radially outer support portion to radially support the outer conductor opposite the compressible ring.

27 Claims, 21 Drawing Sheets

U.S. PATENT DOCUMENTS

| | | | | |
|---|---|---|---|---|
| 5,576,675 | A | 11/1996 | Oldfield | 333/260 |
| 5,722,856 | A | 3/1998 | Fuchs et al. | 439/578 |
| 5,785,554 | A | 7/1998 | Ohshiro | 439/584 |
| 5,795,188 | A | 8/1998 | Harwath | 439/583 |
| 5,830,009 | A | 11/1998 | Tettinger | 439/578 |
| 5,938,474 | A | 8/1999 | Nelson | 439/583 |
| 6,019,636 | A | 2/2000 | Langham | 439/584 |
| 6,109,964 | A | 8/2000 | Kooiman | 439/583 |
| 6,133,532 | A | 10/2000 | Lundback et al. | 174/88 C |
| 6,148,513 | A | 11/2000 | Schiefer et al. | 29/858 |
| 6,203,368 | B1 | 3/2001 | Weidner | 439/579 |
| 6,267,621 | B1 | 7/2001 | Pitschi et al. | 439/584 |
| 6,309,250 | B1 | 10/2001 | Hyzin | 439/578 |
| 6,332,808 | B1 | 12/2001 | Kanda et al. | 439/584 |
| 6,386,915 | B1 | 5/2002 | Nelson | 439/584 |
| 6,396,367 | B1 | 5/2002 | Rosenberger | 333/260 |
| 6,439,924 | B1 | 8/2002 | Kooiman | 439/578 |
| 6,462,637 | B1 | 10/2002 | Laverick | 336/107 |
| 6,607,398 | B2 | 8/2003 | Henningsen | 439/578 |
| 6,668,459 | B2 | 12/2003 | Henningsen | 30/90.2 |
| 6,692,300 | B2 | 2/2004 | Kanda et al. | 439/583 |
| 6,793,529 | B1 | 9/2004 | Buenz | 439/583 |
| 6,802,739 | B2 | 10/2004 | Henningsen | 439/584 |
| 6,808,415 | B1 | 10/2004 | Montena | 439/584 |
| 6,824,415 | B2 | 11/2004 | Wlos | 439/348 |
| 6,835,095 | B2 | 12/2004 | Chen | 439/578 |
| 6,848,931 | B2 | 2/2005 | McMullen et al. | 439/350 |
| 6,848,939 | B2 | 2/2005 | Stirling | 439/578 |
| 6,848,941 | B2 | 2/2005 | Wlos et al. | 439/585 |
| 6,863,565 | B1 | 3/2005 | Kogan et al. | 439/580 |
| 6,893,290 | B2 | 5/2005 | Buenz et al. | 439/578 |
| 6,926,555 | B2 | 8/2005 | Nelson | 439/578 |
| 6,939,169 | B2 | 9/2005 | Islam et al. | 439/578 |
| 7,008,264 | B2 | 3/2006 | Wild | 439/578 |
| 7,011,546 | B2 | 3/2006 | Vaccaro | 439/580 |
| 7,059,162 | B1 | 6/2006 | Tarpill et al. | 72/112 |
| 7,077,700 | B2 | 7/2006 | Henningsen | 439/583 |
| 7,104,839 | B2 | 9/2006 | Henningsen | 439/578 |
| 7,121,883 | B1 | 10/2006 | Petersen et al. | 439/582 |
| 7,134,189 | B2 | 11/2006 | Buenz et al. | 29/748 |
| 7,144,272 | B1 | 12/2006 | Burris et al. | 439/578 |
| 7,156,696 | B1 | 1/2007 | Montena | 439/584 |
| 7,163,420 | B2 | 1/2007 | Montena | 439/578 |
| 7,179,121 | B1 | 2/2007 | Burris et al. | 439/578 |
| 7,329,149 | B2 | 2/2008 | Montena | 439/584 |
| 7,335,059 | B2 | 2/2008 | Vaccaro et al. | 439/578 |
| 7,381,089 | B2 | 6/2008 | Hosler, Sr. | 439/578 |
| 7,422,477 | B2 | 9/2008 | Eriksen | 439/578 |
| 7,435,135 | B2 | 10/2008 | Wlos | 439/584 |
| 7,448,906 | B1 | 11/2008 | Islam | 439/578 |
| 7,621,778 | B1 | 11/2009 | Paynter | 439/583 |
| 7,632,143 | B1 * | 12/2009 | Islam | 439/583 |
| 7,635,283 | B1 * | 12/2009 | Islam | 439/583 |
| 7,798,847 | B2 | 4/2010 | Islam | 439/578 |
| 7,727,013 | B1 | 6/2010 | Paynter | 439/578 |
| 7,731,529 | B1 * | 6/2010 | Islam | 439/583 |
| 7,785,144 | B1 * | 8/2010 | Islam | 439/583 |
| 7,798,848 | B2 | 9/2010 | Islam | 439/584 |
| 7,806,724 | B2 | 10/2010 | Paynter | 439/578 |
| 7,824,214 | B2 | 11/2010 | Paynter | 439/578 |
| 7,824,215 | B2 | 11/2010 | Islam | 439/578 |
| 2005/0079760 | A1 | 4/2005 | Vaccaro | 439/578 |
| 2005/0118865 | A1 | 6/2005 | Henningsen | 439/578 |
| 2006/0112549 | A1 | 6/2006 | Henningsen | 29/857 |
| 2006/0134979 | A1 | 6/2006 | Henningsen | 439/583 |
| 2007/0149047 | A1 | 6/2007 | Wild et al. | 439/578 |
| 2009/0053931 | A1 | 2/2009 | Islam | 439/578 |
| 2009/0186521 | A1 | 7/2009 | McMullen et al. | 439/578 |
| 2010/0016011 | A1 * | 1/2010 | Alen | 455/550.1 |
| 2010/0126011 | A1 | 5/2010 | Islam | 29/751 |

FOREIGN PATENT DOCUMENTS

| | | |
|---|---|---|
| DE | 19729876 | 2/1999 |
| EP | 0798815 | 10/1997 |
| EP | 1956687 | 8/2008 |

OTHER PUBLICATIONS

U.S. Appl. No. 12/277,125, filed Nov. 24, 2008, Islam.
U.S. Appl. No. 12/277,152, filed Nov. 24, 2008, Islam.
U.S. Appl. No. 12/277,162, filed Nov. 24, 2008, Islam.

* cited by examiner

CONNECTOR INCLUDING FLEXIBLE FINGERS AND ASSOCIATED METHODS

FIELD OF THE INVENTION

The present invention relates to the field of connectors, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

U.S. Pat. No. 7,435,135 to Wlos discloses a coaxial cable connector with spring finger back nut telescopically coupled via threads to a coaxial cable end. A nut bore in the spring finger back nut receives an outer conductor of the coaxial cable. There are a plurality of spring fingers around the periphery of the nut bore, each having in inward projecting bead. Respective ends of the spring fingers are deflectable into an annular groove between the spring fingers and an outer diameter of the spring finger back nut.

U.S. Pat. No. 5,795,188 to Harwath, for example, discloses a connector for a coaxial cable having a corrugated outer conductor. The connector includes a connector housing defining a radially outer ramp to contact the inside surface of a flared end portion of an outer conductor of the coaxial cable. A clamping ring is in the corrugation adjacent to the flared end portion of the outer conductor. The clamping ring presses the outer surface of the outer conductor against the radially outer ramp to provide electrical contact therebetween.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

U.S. Pat. No. 7,077,700 to Henningsen discloses a coaxial cable connector including a removable back nut, an outer body, and a center conductor supported within the outer body by a dielectric. An uncompressible clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is clamped between mating clamping surfaces formed on the clamp ring and the outer body.

Despite these developments in connector technology, a need remains for connectors that may facilitate easy installation and that may retain a good electrical and mechanical contact with the coaxial cable under a variety of operating conditions. Further, a need remains for connectors that may be securely attached to a coaxial cable and that are sealed against debris and moisture.

SUMMARY OF THE INVENTION

In view of the foregoing background, it is therefore an object of the present invention to provide an easier to install connector for a coaxial cable that maintains a good electrical contact with the coaxial cable under a variety of operating conditions.

This and other objects, features, and advantages in accordance with the present invention are provided by a coaxial cable connector to be attached to a coaxial cable comprising an inner conductor, an outer conductor, and a dielectric therebetween. The connector may comprise a connector housing defining a ramp to receive the outer conductor thereagainst and a back nut comprising a ring base and a plurality of flexible fingers extending forwardly therefrom to clamp against the outer conductor opposite the ramp. This advantageously provides secure mechanical and electrical connections between the outer conductor and the connector housing. Furthermore, this maintains a sufficient clamping force on the outer conductor opposite the radially outer ramp during vibration of the connector or if the size and/or shape of the outer conductor changes due to thermal expansion or aluminum creep.

Each of the plurality of flexible fingers may have a bend therein. Additionally or alternatively, each of the plurality of fingers may have a portion with a reduced thickness to deflect in response to longitudinal compression of that flexible finger. This advantageously allows the coaxial cable connector to be used with a variety of coaxial cables having outer conductors of different thicknesses.

The connector housing and the back nut may include respective portions defining a positive stop when fully engaged. The positive stop may allow the connector to be attached to the coaxial cable without a torque wrench or other torque limiting tool, as the positive stop indicates to the installer when to stop tightening the back nut and the connector housing together.

There may be a center contact to be coupled to the inner conductor. At least one insulator member may be in the connector housing for carrying the center contact and comprising a radially outer support portion to radially support the outer conductor opposite the plurality of flexible fingers. This radial support portion supports the outer conductor radially outwardly as the plurality of flexible fingers urge the outer conductor radially inwardly.

At least one of the plurality of flexible fingers may have a plurality of serrations extending from a surface thereof to engage the outer conductor. These serrations may 'bite' into the outer conductor to thereby securely attach the connector housing on the coaxial cable and increase coaxial cable retention torque. In addition, the serrations help prevent longitudinal movement of the coaxial cable connector relative to the coaxial cable due to tensile forces. Moreover, the serrations reduce intramodulation distortion (IMD) by reducing radial movement of the coaxial cable connector about the coaxial cable.

The connector housing may comprise an enlarged diameter tool engaging portion and the back nut may comprises a rearward end. The positive stop may be defined by the enlarged diameter tool engaging portion and the rearward end.

The at least one insulator member may comprise a first insulator member having a central opening defined therein to carry the center contact. The at least one insulator member may further comprise a second insulator member longitudinally spaced apart from, and positioned forwardly of, the insulator member in the connector housing and also having a central opening defined therein to carry the center contact.

The ramp may have a stair-stepped shape or a knurled shape. This stair-stepped or knurled shape may present an increased friction surface to the outer conductor to help prevent unwanted movement of the outer conductor. This stair-stepped or knurled shape may also enhance the electrical contact with the outer conductor.

At least one sealing ring may be carried within the back nut. This sealing ring may seal the interior of the connector housing and the back nut from moisture and debris.

The insulator member may comprise a retaining projection extending therefrom and an annular groove may be defined on a radially inner surface of the connector housing to receive the retaining projection. This retaining projection helps to securely locate and retain the insulator member in the back nut. The connector housing may comprise a rearward portion threadingly received within a forward portion of the back nut.

A method aspect is directed to a method of making a connector to be attached to a coaxial cable comprising an inner conductor, an outer conductor, and a dielectric therebetween. The method may comprise forming a connector housing to have a ramp to receive the outer conductor thereagainst and forming a back nut comprising a ring base and a plurality of flexible fingers extending forwardly therefrom to clamp against the outer conductor opposite the ramp.

The connector housing and the back nut may be formed to have respective portions defining a positive stop when fully engaged. A center contact may be formed to be coupled to the inner conductor. At least one insulator member may be formed to be positioned in the connector housing for carrying the center contact and comprising a radially outer support portion to radially support the outer conductor opposite the plurality of fingers.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Figure 1:
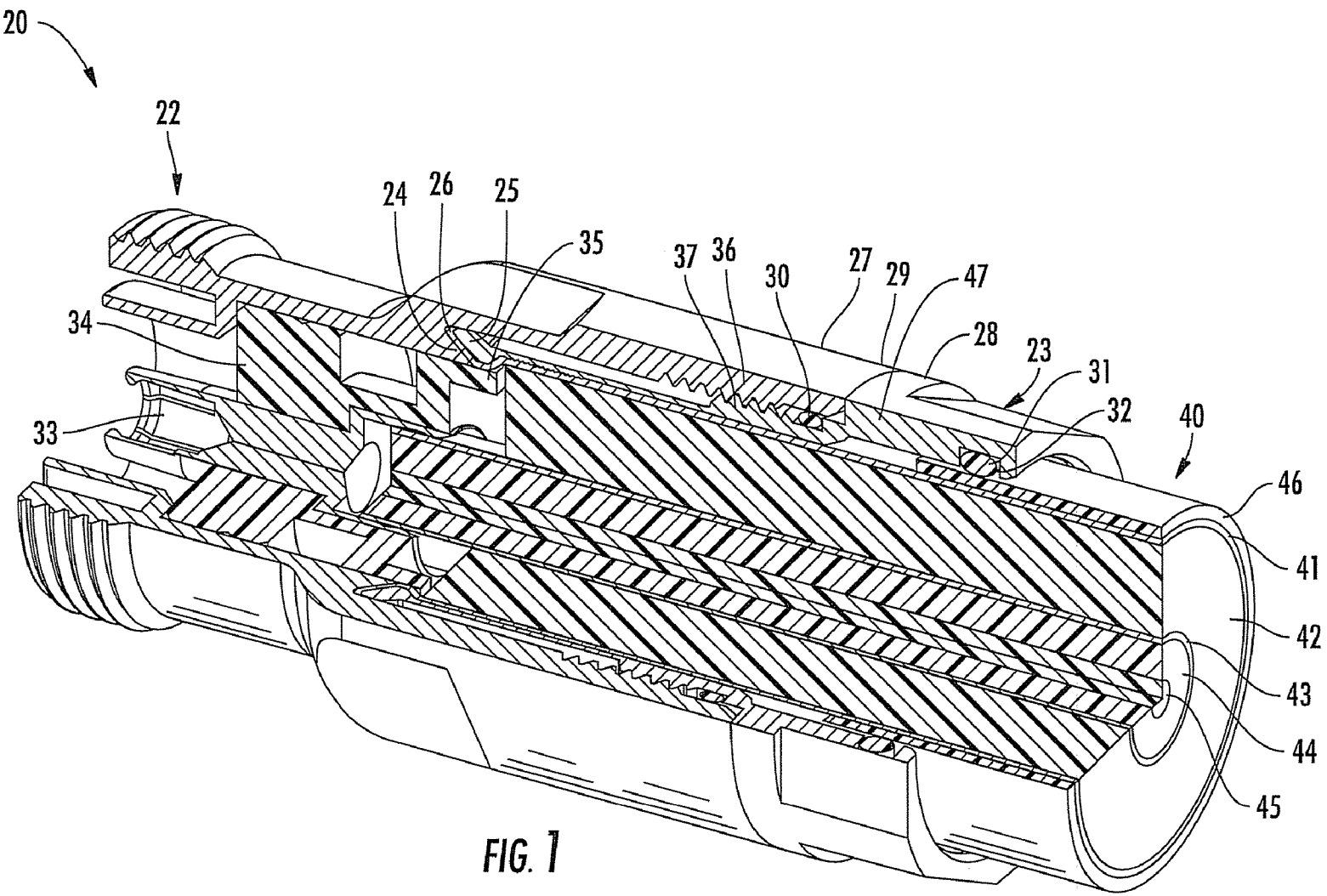
FIG. 1 is a perspective cutaway view of a coaxial cable connector installed on the end of a coaxial cable having a smooth outer conductor, in accordance with the present invention.
Figure 2:
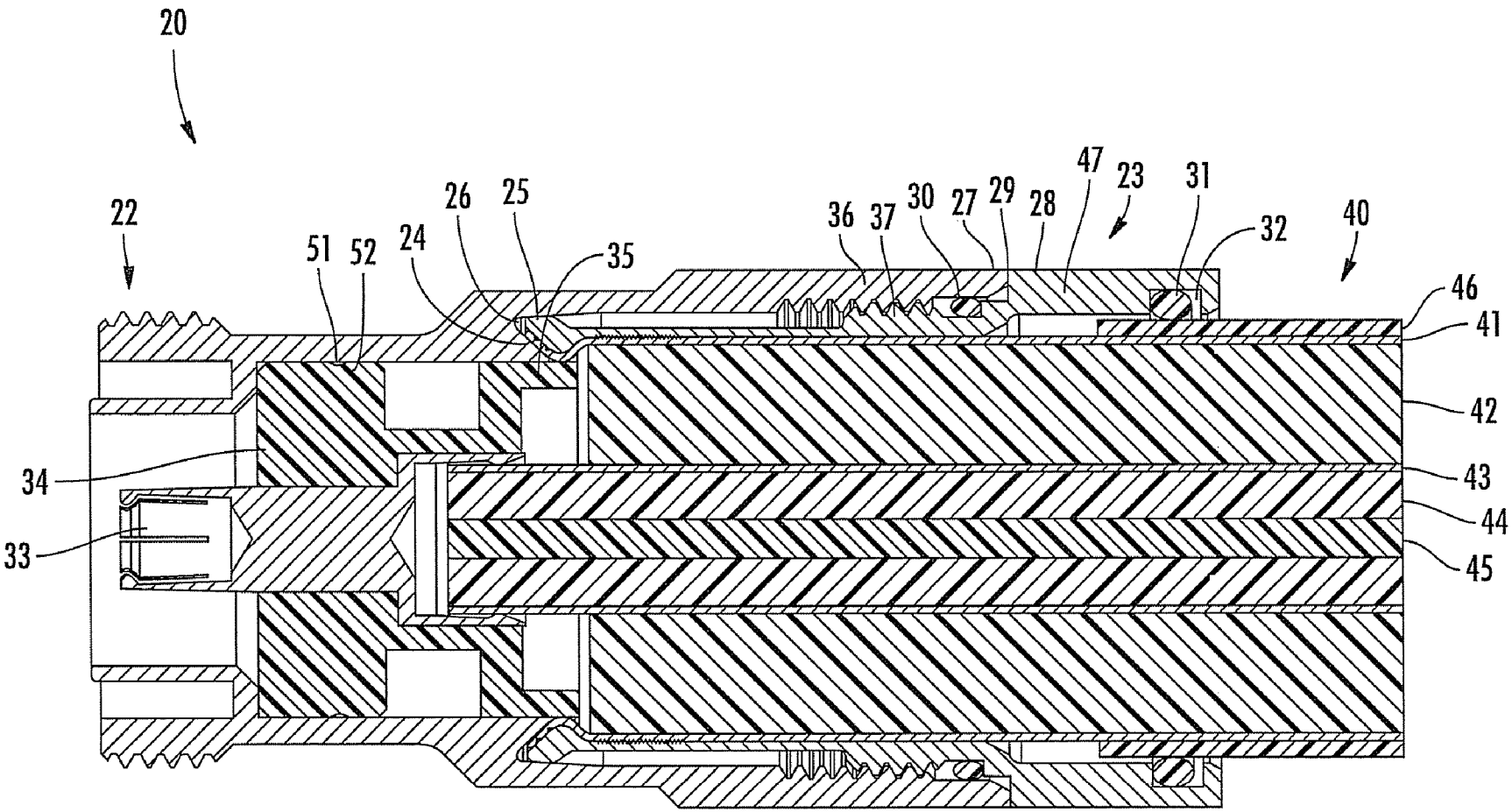
FIG. 2 is a longitudinal cross-sectional view of the coaxial cable connector of FIG. 1.
Figure 3:
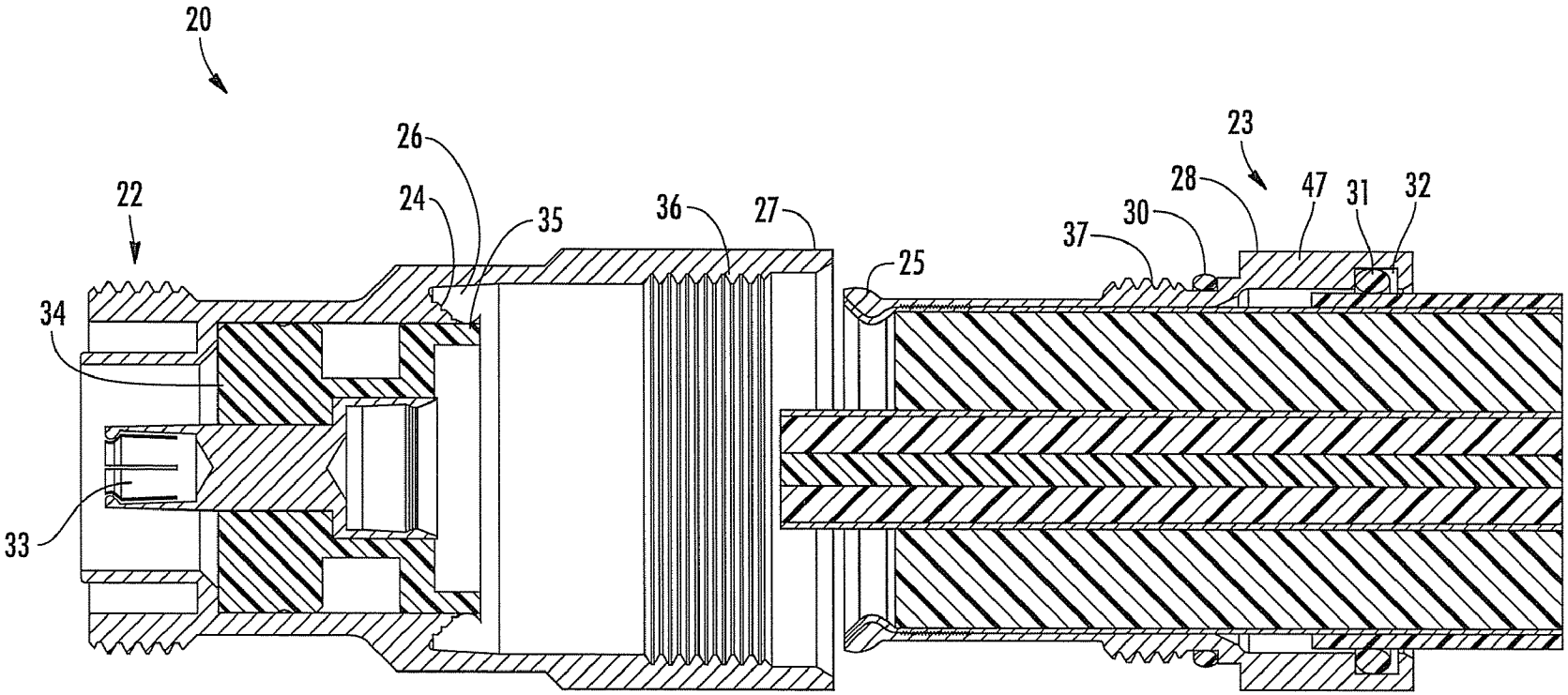
FIG. 3 is an exploded longitudinal cross-sectional view of the connector of FIG. 1.

Referring initially to FIGS. 1-3, a connector 20 attached to a coaxial cable 40 is now described. The coaxial cable 40 comprises an inner conductor 43, an outer conductor 41, and a dielectric 42 therebetween. The inner conductor 43 is a hollow inner conductor with an inner conductor filament 45, and an inner conductor dielectric 44 therebetween. Of course, the inner conductor 43 may instead be a hollow inner conductor. The outer conductor 41 is illustratively a smooth outer conductor with a flared end, but could be a corrugated outer conductor in other embodiments. The dielectrics 42, 44 may be foam dielectrics or other dielectrics as known to those skilled in the art.

The connector 20 includes an internally threaded back nut 23 to receive an externally threaded rearward end of a connector housing 22. A forward o-ring 30 and a rearward o-ring 31 are illustratively provided to seal respective forward and rearward interfaces adjacent the back nut 23 and reduce or prevent moisture ingress. The rearward o-ring 31 is positioned within an o-ring pocket 32.

Figure 15:
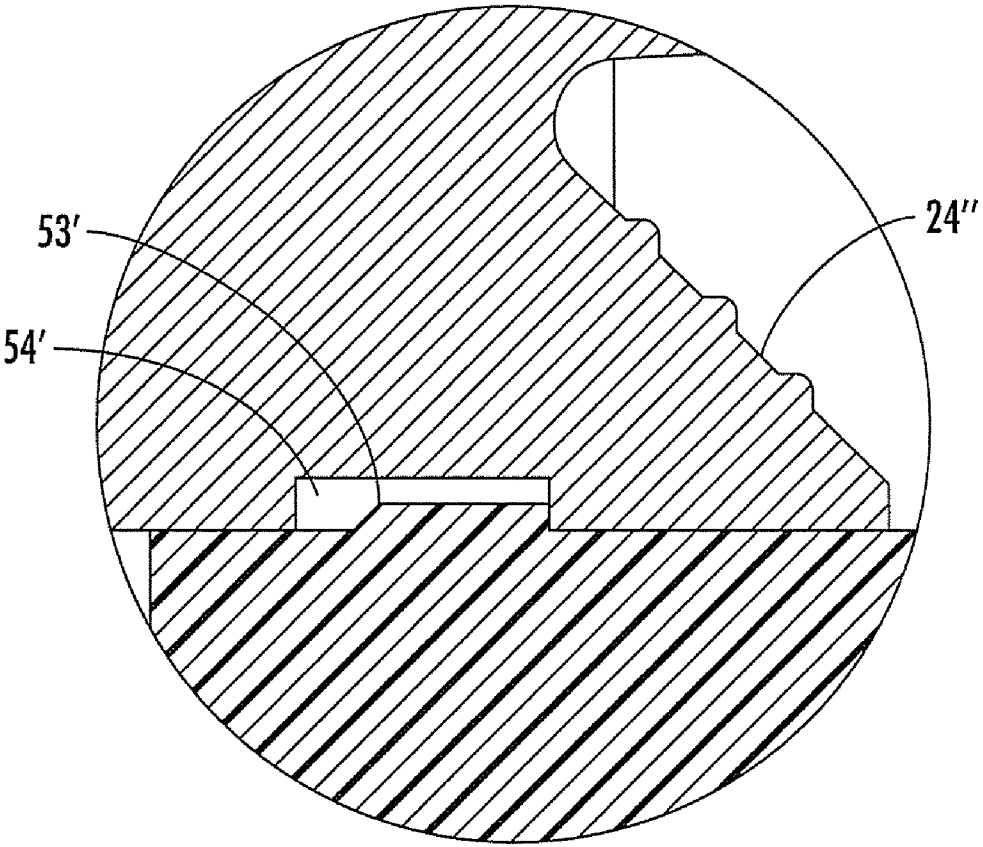
FIG. 15 is a greatly enlarged longitudinal cross sectional view of the retaining projection and insulator member of the coaxial cable connector of FIG. 12.

The connector housing 22 defines a ramp 24 to receive the outer conductor 41 thereagainst. As perhaps best shown in FIGS. 4-6, the ramp 24 illustratively has stair-stepped surface, although the skilled artisan will understand that other ramp surfaces may be used. For example, as shown in the embodiment of FIG. 15, the ramp 24 may have a knurled surface.

The end of the coaxial cable 40 is prepared so that the inner conductor 43 extends longitudinally outwardly beyond the end of the outer conductor 41. In addition, portions of the dielectric 42 are removed so that the inner surface of the outer conductor 41 is also exposed. The coaxial cable 40 illustratively includes an outer insulation jacket 44 stripped back a distance so that outer end portions of the outer conductor 41 are exposed. The outer conductor 41 is flared outwardly to define a flared end.

A portion of the connector housing 22 and a portion of the back nut 23 include respective portions defining a positive stop 29 when fully engaged. More particularly, the connector housing 22 comprises an enlarged diameter tool engaging portion 27 and the back nut 23 comprises a forward end 28. The positive stop 29 is defined by the enlarged diameter tool engaging portion 27 and the forward end 28 of the back nut 23. The forward o-ring 30 is radially inward of and adjacent to the positive stop 29.

It should of course be understood that other variations of the positive stop 29 are possible. Indeed, the connector housing 22 may have a rear portion to engage with a shoulder of the back nut 23 to define the positive stop 29.

The positive stop 29 helps prevent overtightening of the engagement between the connector housing 22 and the back nut 23 that may generate compression and or shearing forces at potentially damaging levels. The positive stop 29 therefore facilitates easy installation of the connector 20 on the coaxial cable 40 by eliminating the need for a torque wrench or other torque limiting tool.

Figure 8:
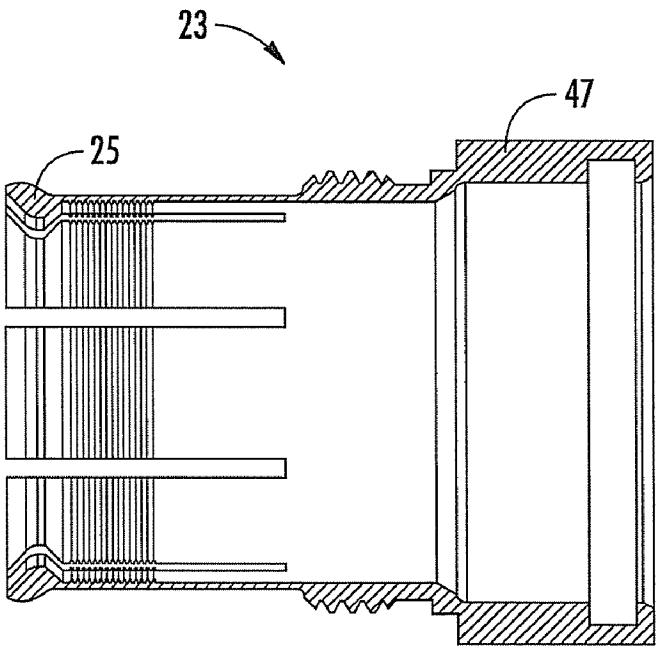
FIG. 8 is a side view of the back nut of the coaxial cable connector of FIG. 1.
Figure 7:
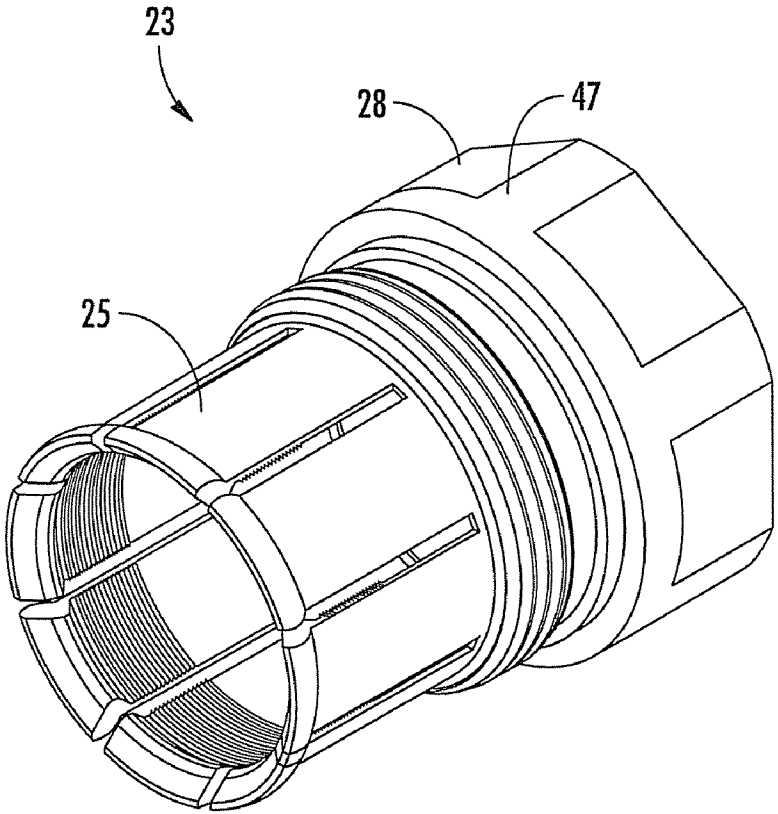
FIG. 7 is a perspective view of the back nut of the coaxial cable connector of FIG. 1.
Figure 9:
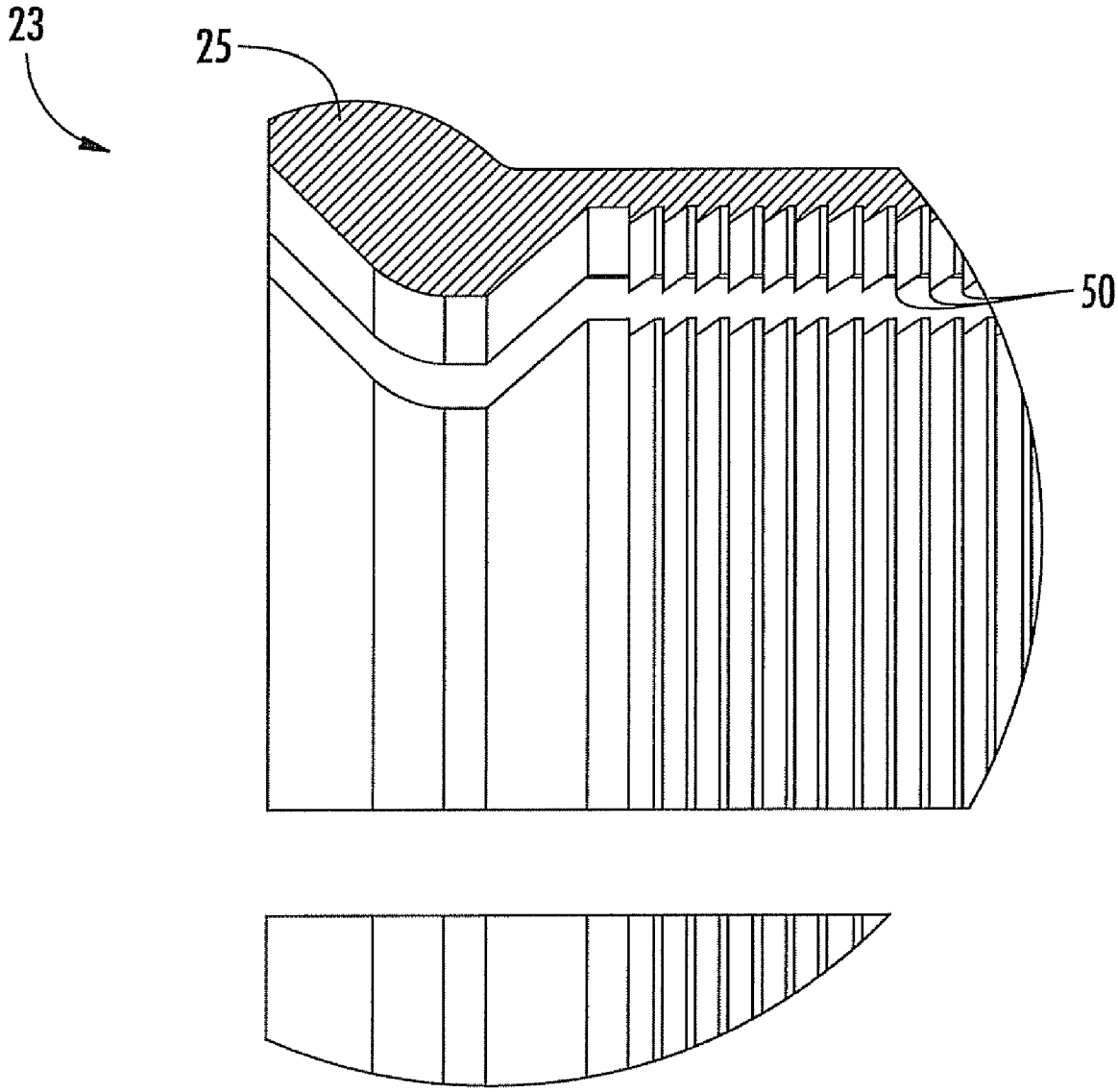
FIG. 9 is an enlarged side view of a flexible finger of the back nut of the coaxial cable connector of FIG. 1.
Figure 11:
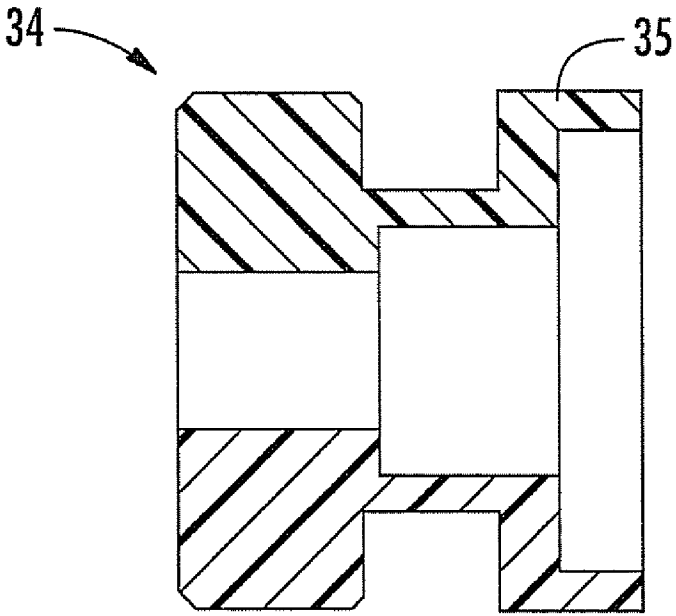
FIG. 11 is a longitudinal cross sectional view of the insulator member of the coaxial cable connector of FIG. 1.
Figure 10:
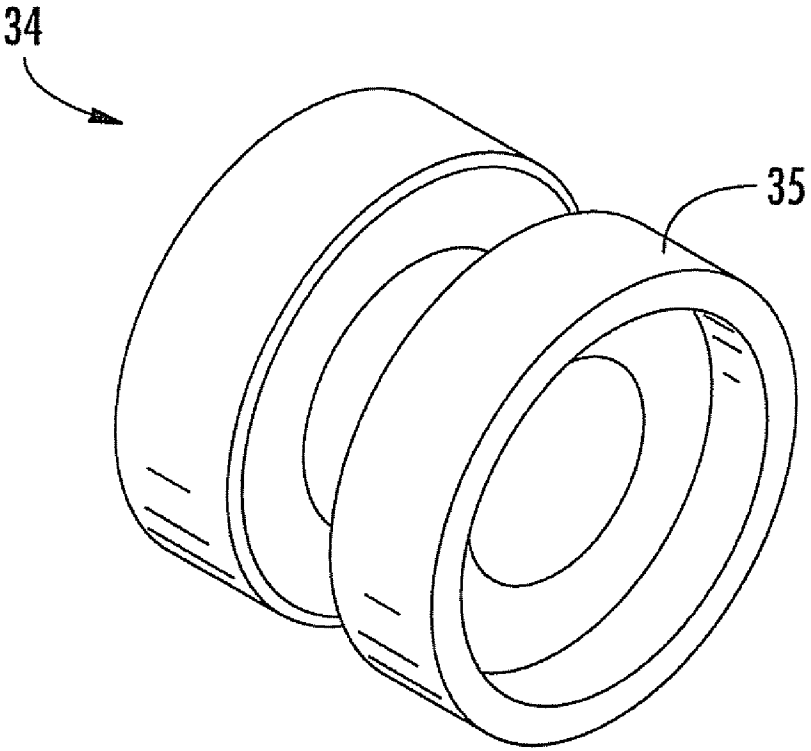
FIG. 10 is a perspective view of the insulator member of the coaxial cable connector of FIG. 1.

As perhaps best shown in FIGS. 7-9, the back nut 23 comprises a ring base 47 and a plurality of flexible fingers 25 extending forwardly therefrom to clamp against the outer conductor 41 opposite the ramp 24. The flexible fingers 25 are flexible in that they may be deflected radially and may bend axially. This axial bending helps facilitate the attachment of the coaxial cable connector 20 to coaxial cables 40 of varying thicknesses. Further, the flexible fingers 25 may be electrically conductive.

The connector housing 22 illustratively has a finger cavity 26 to receive the flexible fingers 25. The plurality of flexible fingers 25 are biased inwardly to compressibly clamp against the outer conductor 41 opposite the ramp 24 as the connector housing 22 and back nut 23 are engaged.

This clamping helps to provide an electrical connection between the outer conductor 41 and the ramp 14 by providing a constant contact pressure between the outer conductor and the ramp. By maintaining such a secure electrical connection, the intermodulation distortion of signals traveling through the coaxial cable 40 may be reduced.

The flexible fingers 25 advantageously maintain a sufficient clamping force on the outer conductor 41 even if the outer conductor changes shape or size due to thermal expansion or aluminum creep, for example, whereas an arrangement of two fixed and inflexible wedging surfaces to clamp the outer conductor might lose clamping force and contact pressure if the outer conductor were to change shape or size. Furthermore, by maintaining a constant clamping force on the outer conductor 41, the flexible fingers 25 allow the connector 20 to be used with both smooth wall outer conductor coaxial cables 40 and corrugated outer conductor coaxial cables. In addition the flexible fingers 25 allow the connector 20 to be used on a variety of coaxial cables with different thicknesses, and on a variety of coaxial cables with outer conductors having different thicknesses.

Figure 4:
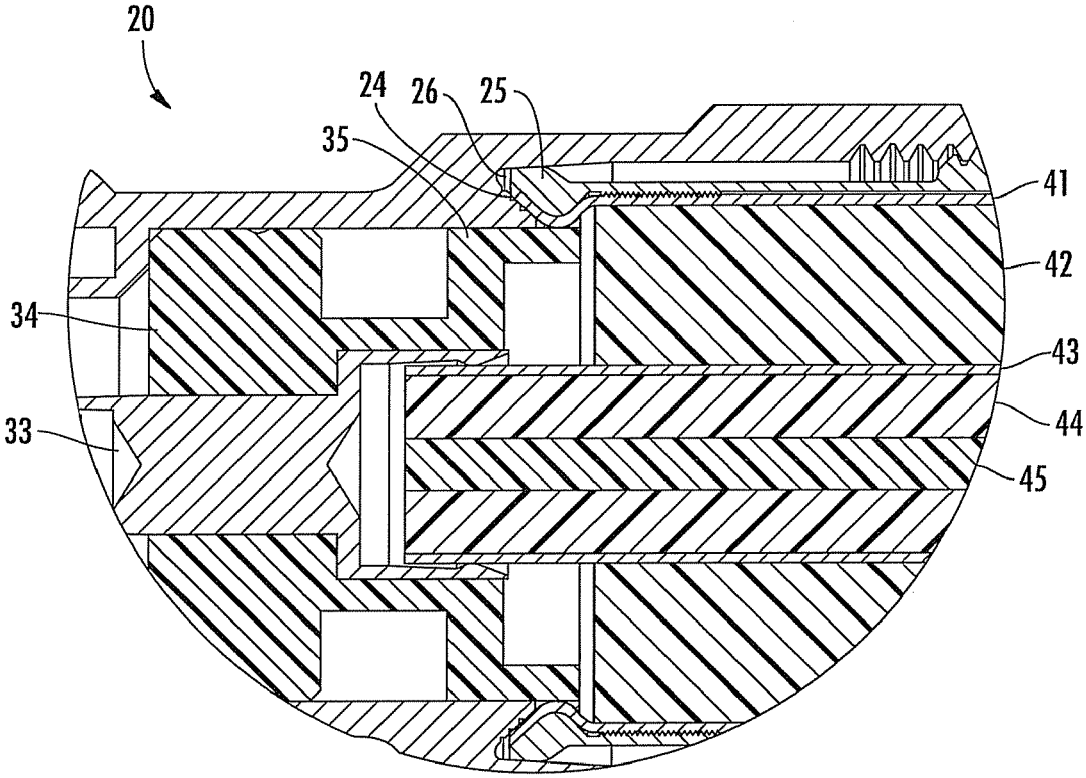
FIG. 4 is a greatly enlarged longitudinal cross-sectional view of the coaxial cable connector of FIG. 1.
Figure 5:
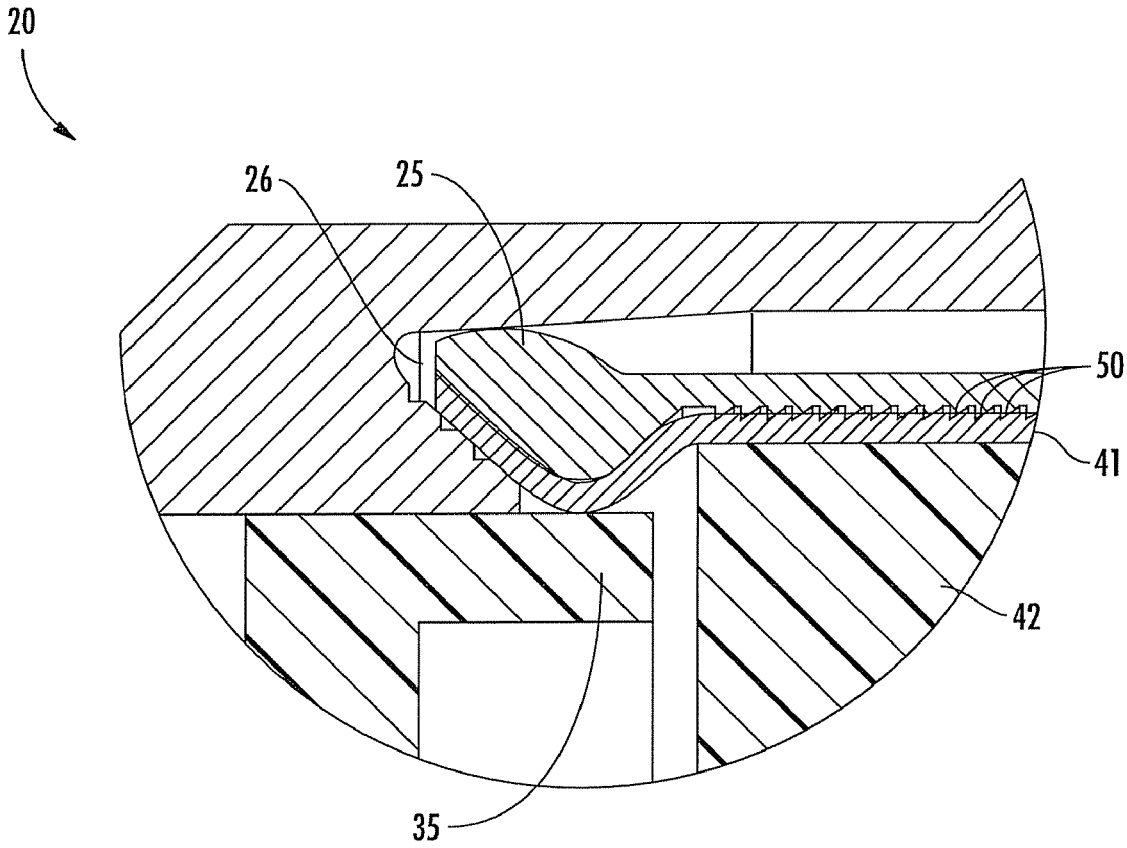
FIG. 5 is a greatly enlarged longitudinal cross-sectional view of the flexible finger and ramp of the coaxial cable connector of FIG. 1.
Figure 6:
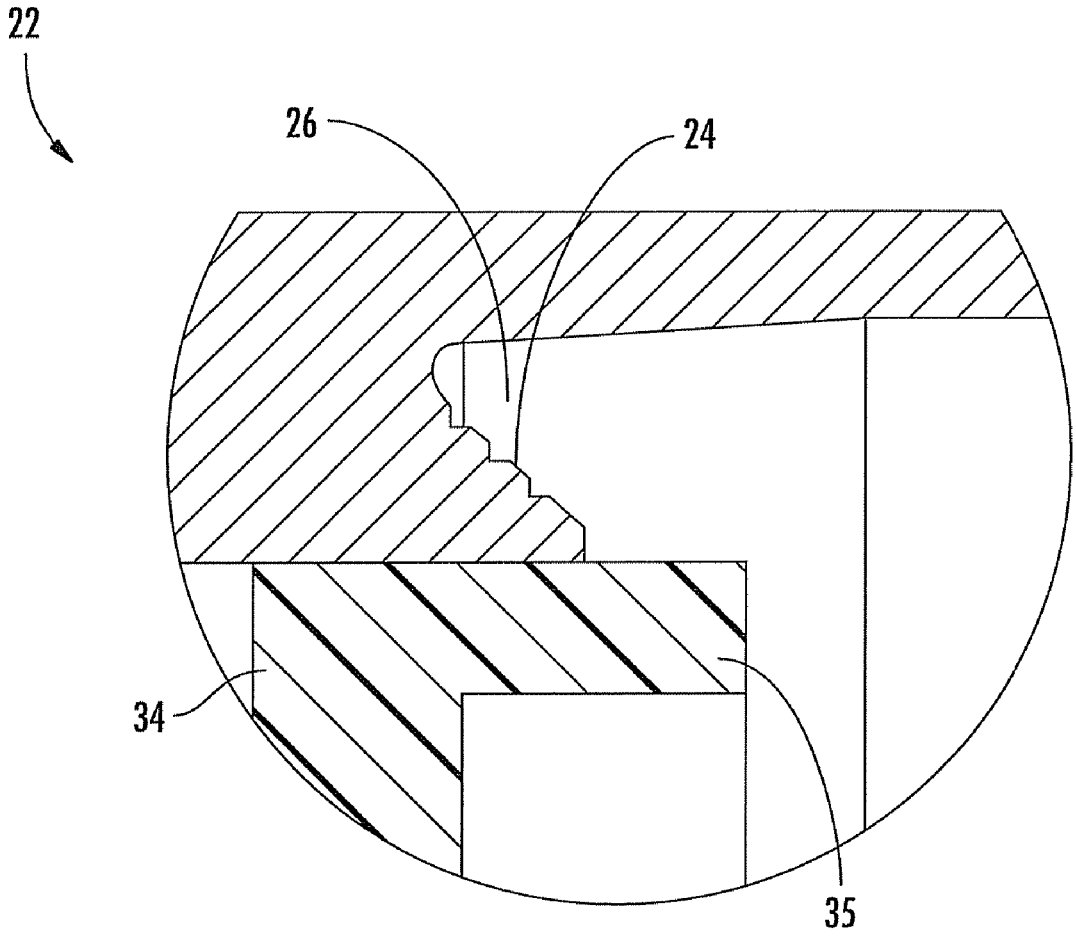
FIG. 6 is a greatly enlarged longitudinal cross sectional view of the ramp of the coaxial cable connector of FIG. 1 wherein the flexible fingers are not shown for clarity.

As perhaps best shown in FIGS. 4-5, the flexible fingers 25 each illustratively have a plurality of serrations 50 extending radially inwardly from a surface thereof. These serrations 50 'bite' into the outer conductor to securely attach the connector housing 22 on the coaxial cable 40 and increase coaxial cable retention torque. In addition, the serrations 50 help prevent longitudinal movement of the coaxial cable connector 20 relative to the coaxial cable due 40 to tensile forces. Moreover, the serrations 50 reduce intramodulation distortion (IMD) by reducing radial movement of the coaxial cable connector 20 about the coaxial cable 40.

Further, these serrations 50 are illustratively angled so that the coaxial cable 40 is longitudinally advanced within the coaxial cable connector 20 as the connector housing 22 and back nut 23 are screwed together. Moreover, one side of the serrations 50 is illustratively perpendicular to the longitudinal axis of the flexible finger 25, while the other side is angled with respect to the longitudinal axis of the flexible finger. Serrations 50 having such a shape may be formed by cutting the flexible fingers 25 using a thread cutter.

Figure 20:
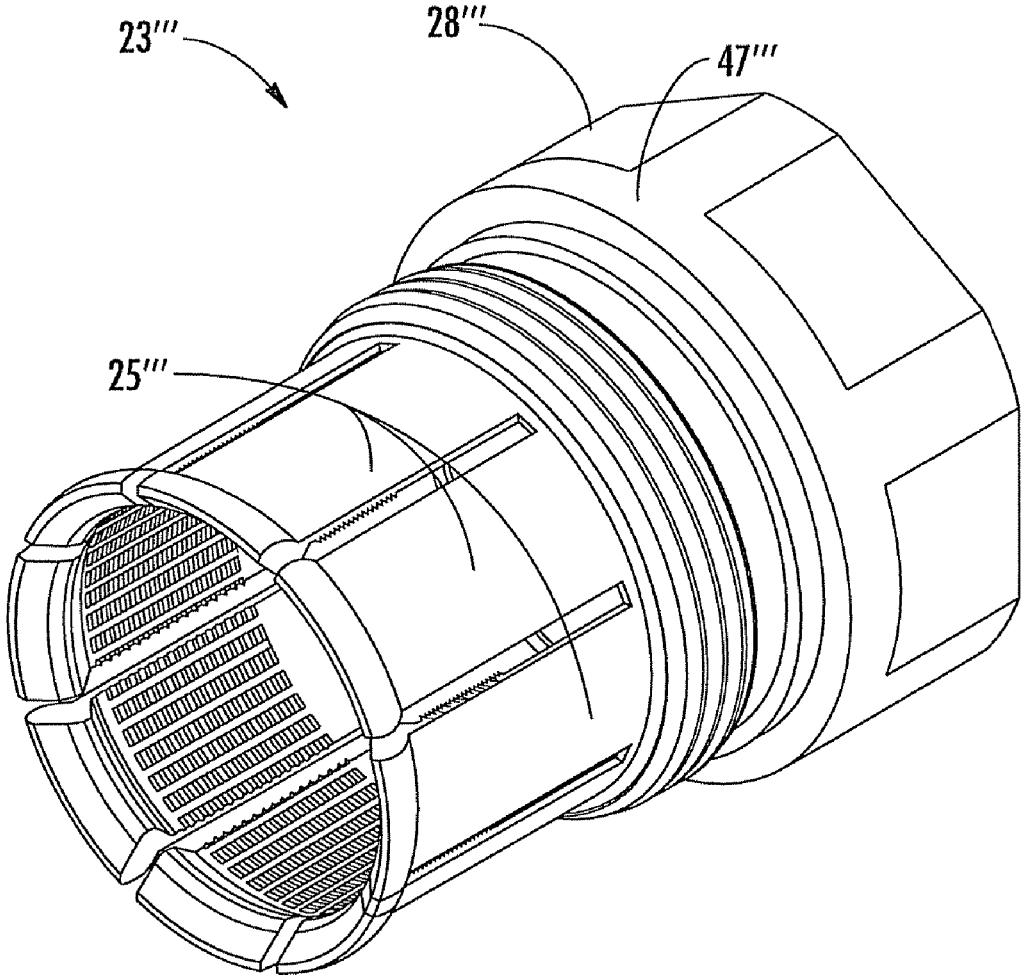
FIG. 20 is a perspective view of an alternative embodiment of the back nut of FIG. 1.
Figure 21:
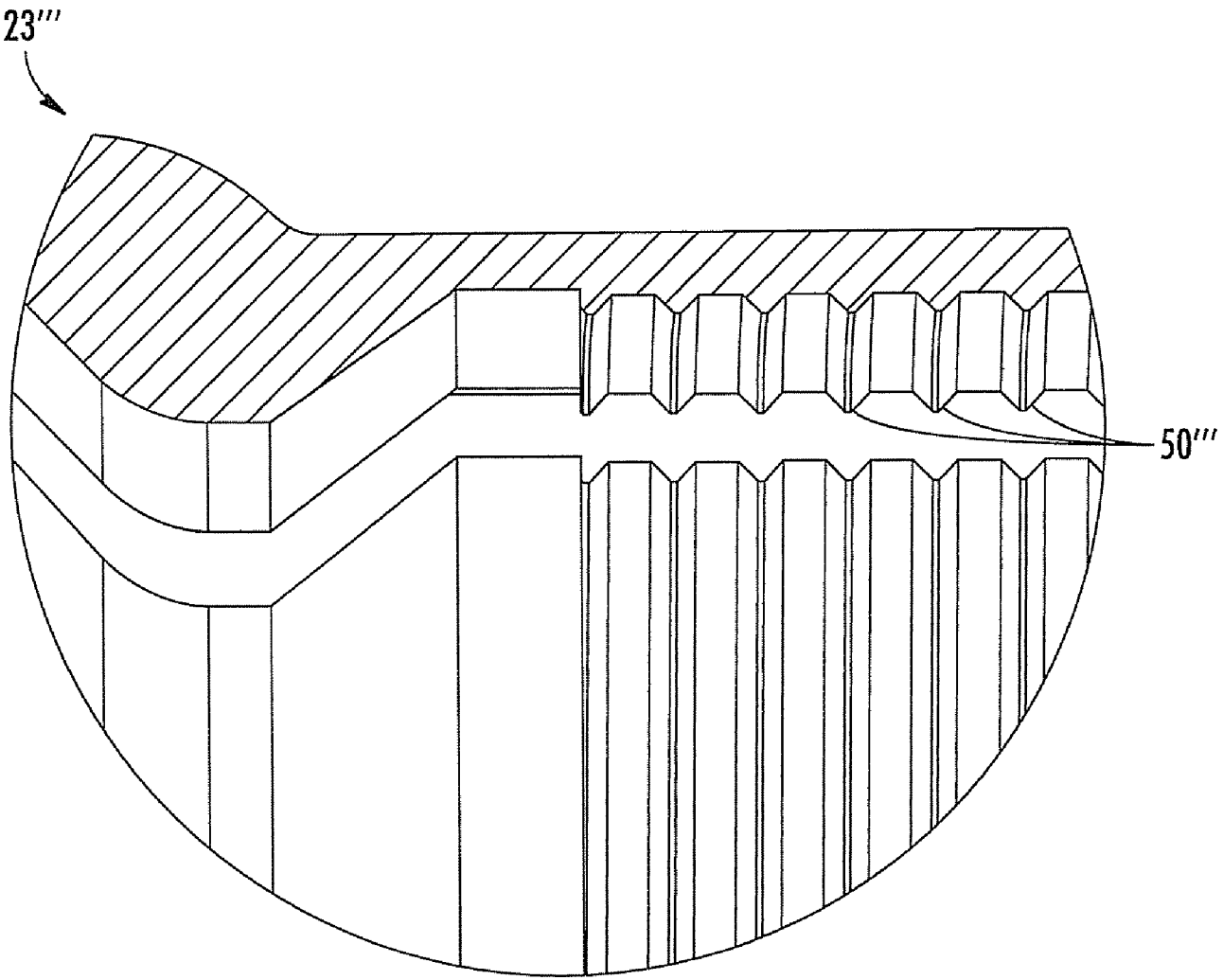
FIG. 21 is a greatly enlarged longitudinal cross sectional view of the back nut of FIG. 17.
Figure 22:
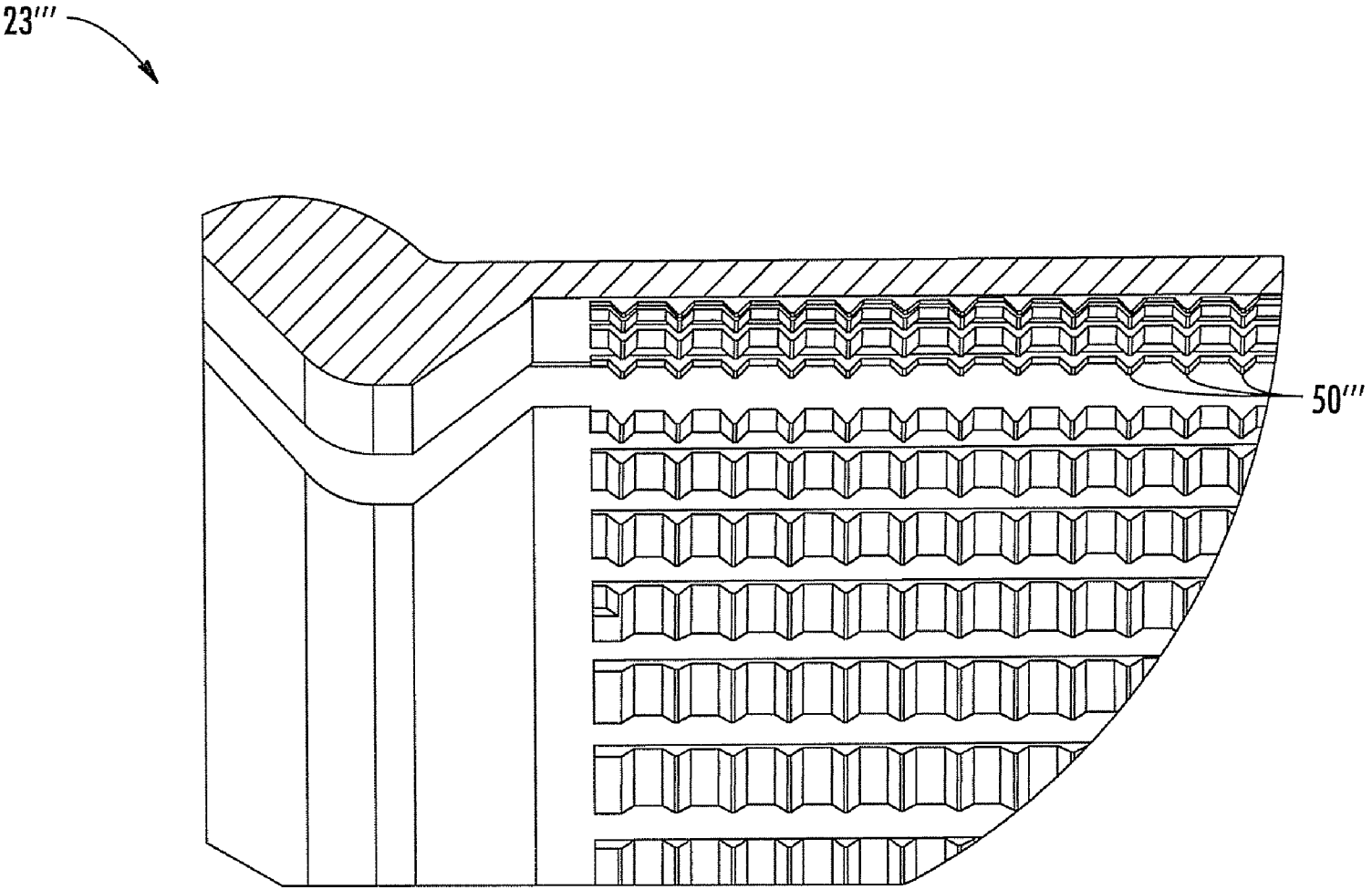
FIG. 22 is an enlarged longitudinal cross sectional view of the back nut of FIG. 17.

Of those, skilled artisans should recognize that these serrations may be formed of any suitable shape. For example, as shown in FIGS. 20-22, the serrations 50''' may have a knurled or diamond knurled shape. Moreover, the tip of each flexible finger 25''' may also have a knurled or diamond knurled shape. Such a knurled tip may help to grasp the end of the outer conductor 41" and to longitudinally advance the outer conductor as the connector housing 22 and back nut 23 are screwed together.

A center contact 33 is supported in the connector housing 22 by the insulator member 34 and is electrically connected to the inner conductor 43. The insulator member 34 is also carries the inner conductor 43 of the cable to reduce or prevent movement to thereby reduce IMD.

The insulator member 34 comprises a radially outer support portion 35 to radially support the outer conductor 41 opposite the flexible fingers 25. This radial support supports the outer conductor 41 radially outwardly as the flexible fingers 25 urge the outer conductor radially inwardly. Furthermore, the radially outer support portion 35 helps to reduce the chance of a loss of electrical contact between the outer conductor 41 and the ramp 24 due to flexing of the coaxial cable 40 or due to compression of the dielectric 42.

The illustrated insulator member 34 is a monolithically formed one-piece unit. Such a monolithic construction helps to reduce the number of connector components and thereby reduce the overall cost of the connector 20.

Figure 14:
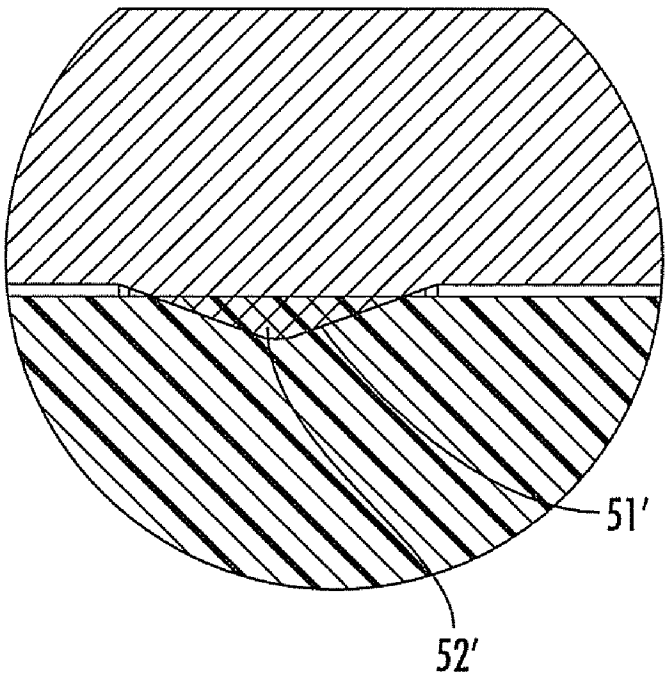
FIG. 14 is a greatly enlarged longitudinal cross sectional view of the retaining projection and annular groove of the coaxial cable connector of FIG. 12 wherein the flexible fingers are not shown for clarity.
Figure 16:
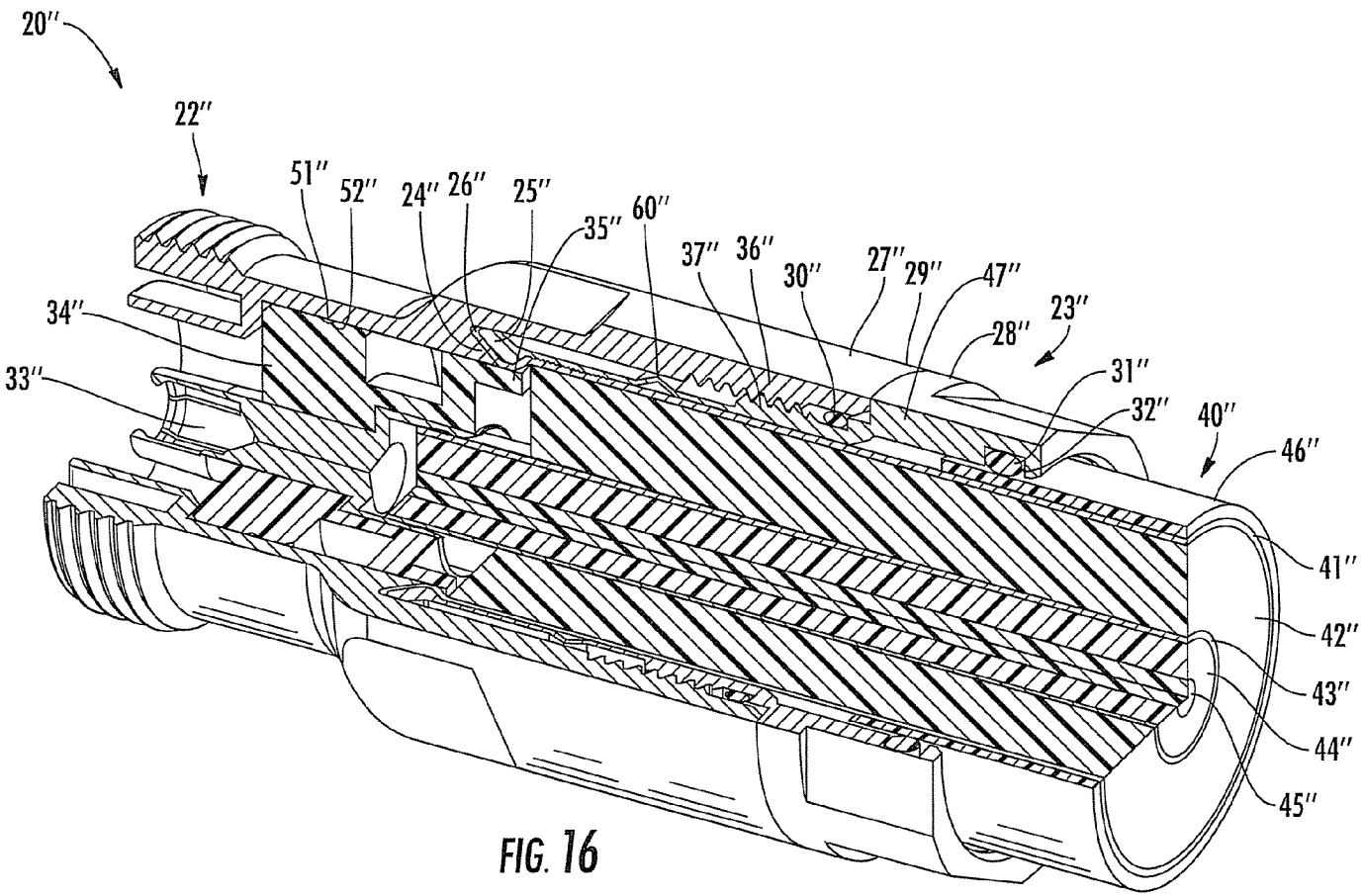
FIG. 16 is a longitudinal cross-sectional view of yet another embodiment of a coaxial cable connector installed on the end of a coaxial cable having a smooth outer conductor, in accordance with the present invention.
Figure 17:
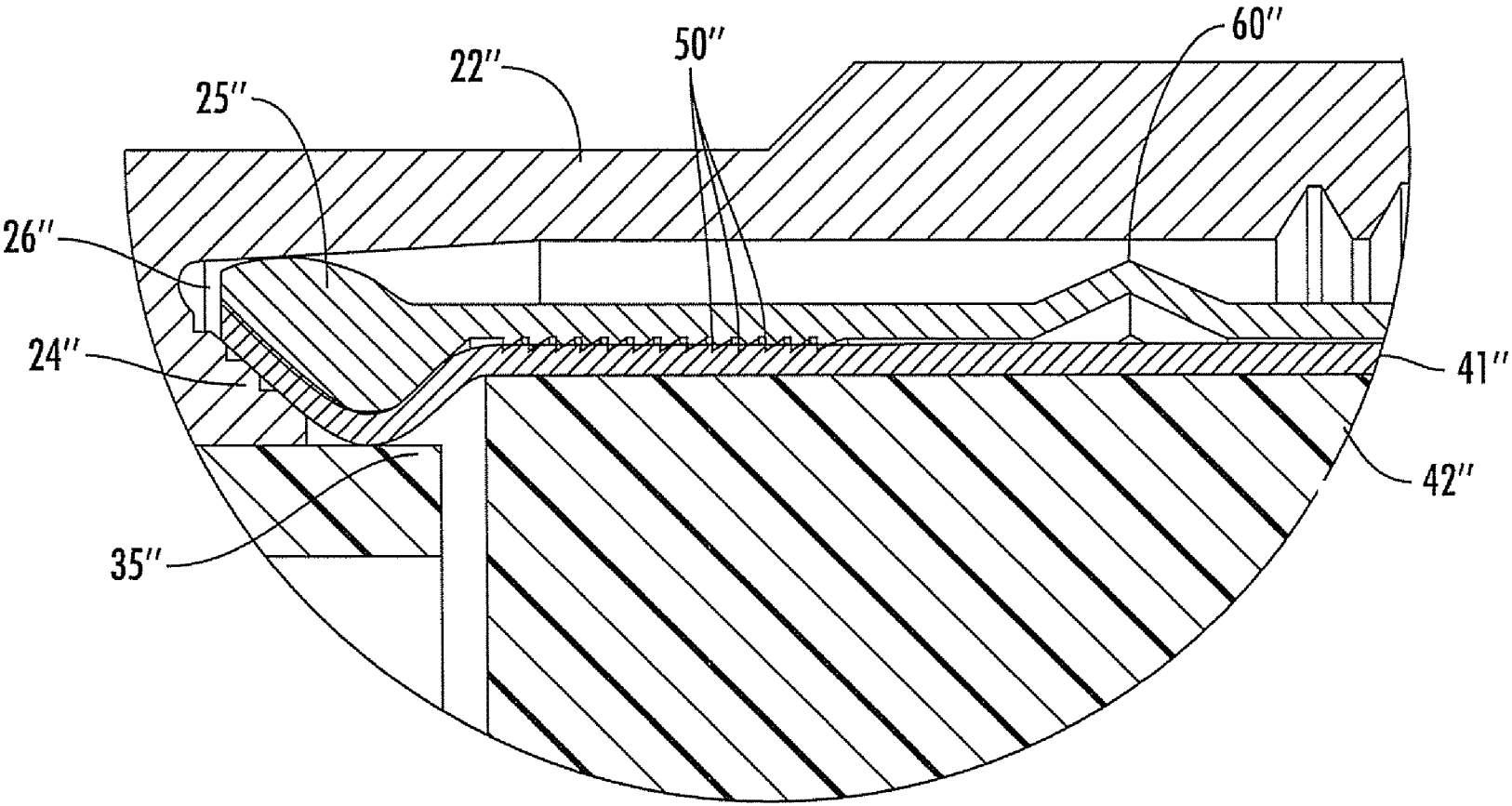
FIG. 17 is a greatly enlarged longitudinal cross-sectional view of a flexible finger of the coaxial cable connector of FIG. 16.
Figure 19:
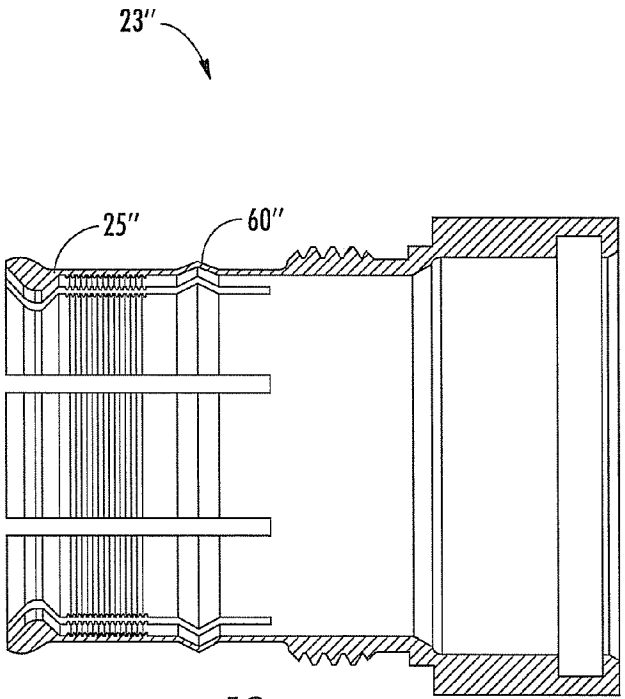
FIG. 19 is a side view of the back nut of FIG. 16.
Figure 18:
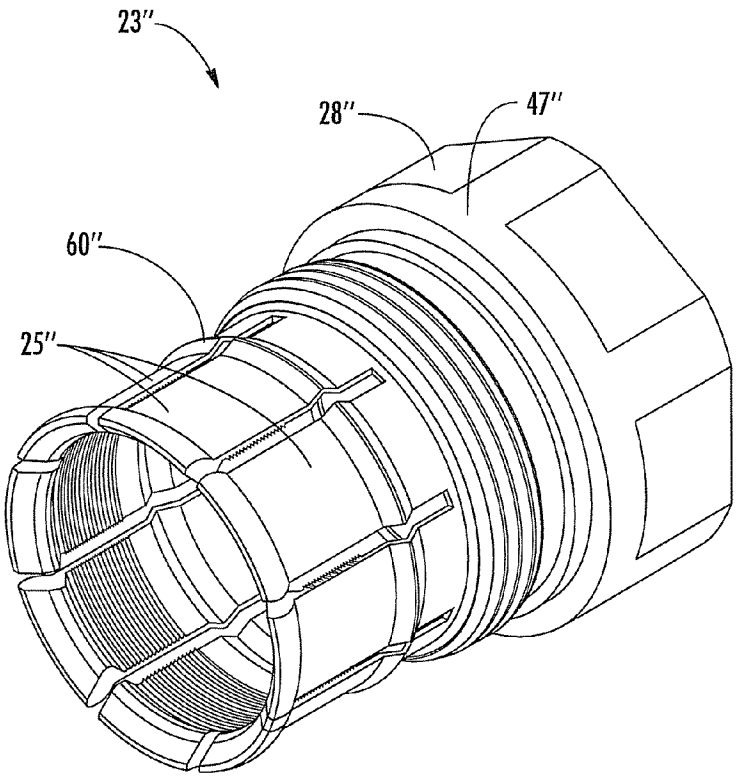
FIG. 18 is a perspective view of the back nut of FIG. 16.

The back nut 23 has a retaining projection 51 that bites into the insulator member 34, causing a depression 52 to form therein (see FIG. 14). This retaining projection 51 helps to secure located and retain the insulator member 34 in the connector housing 22.

Figure 12:
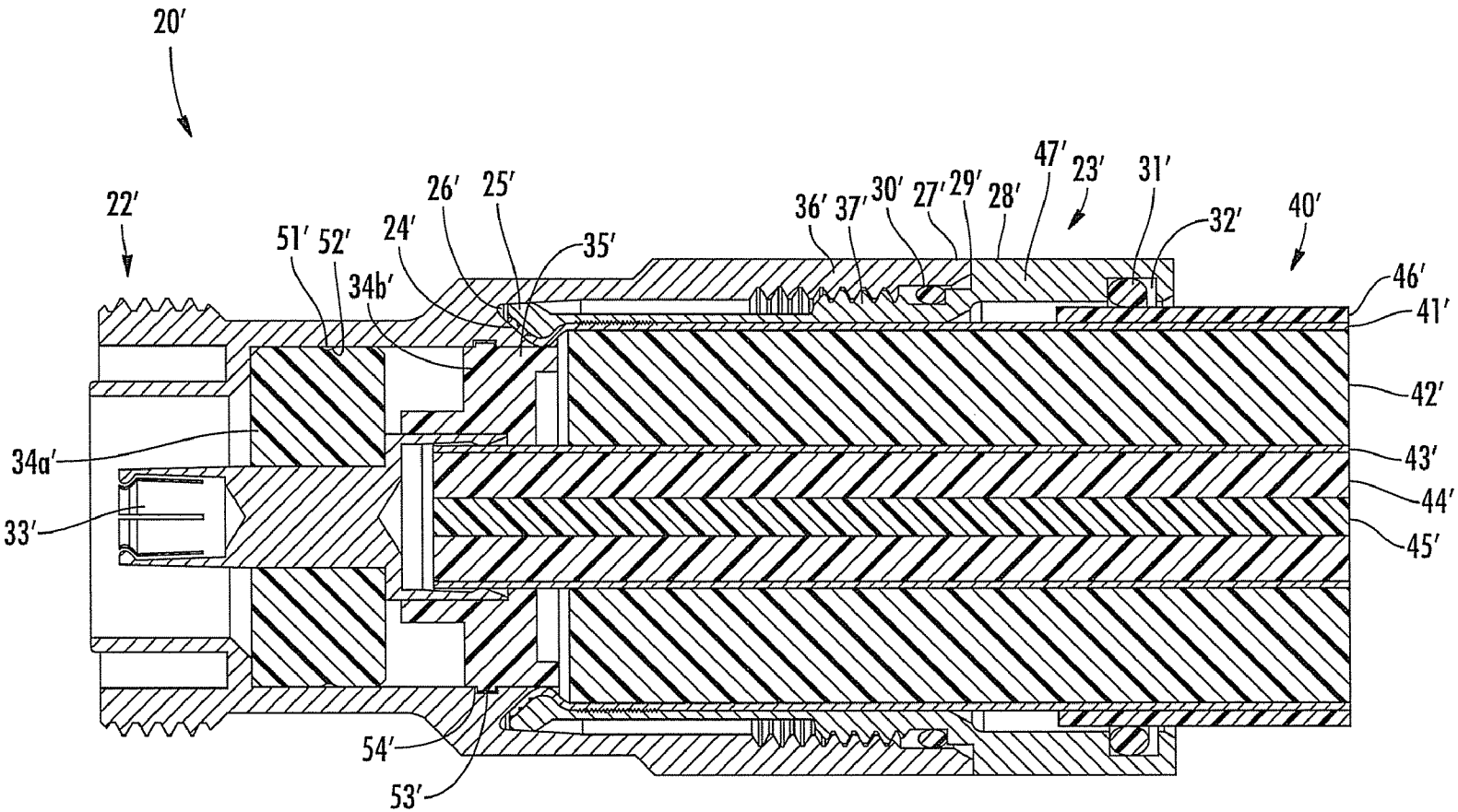
FIG. 12 is a longitudinal cross-sectional view of an alternative embodiment of a coaxial cable connector installed on the end of a coaxial cable having a smooth outer conductor, in accordance with the present invention.
Figure 13:
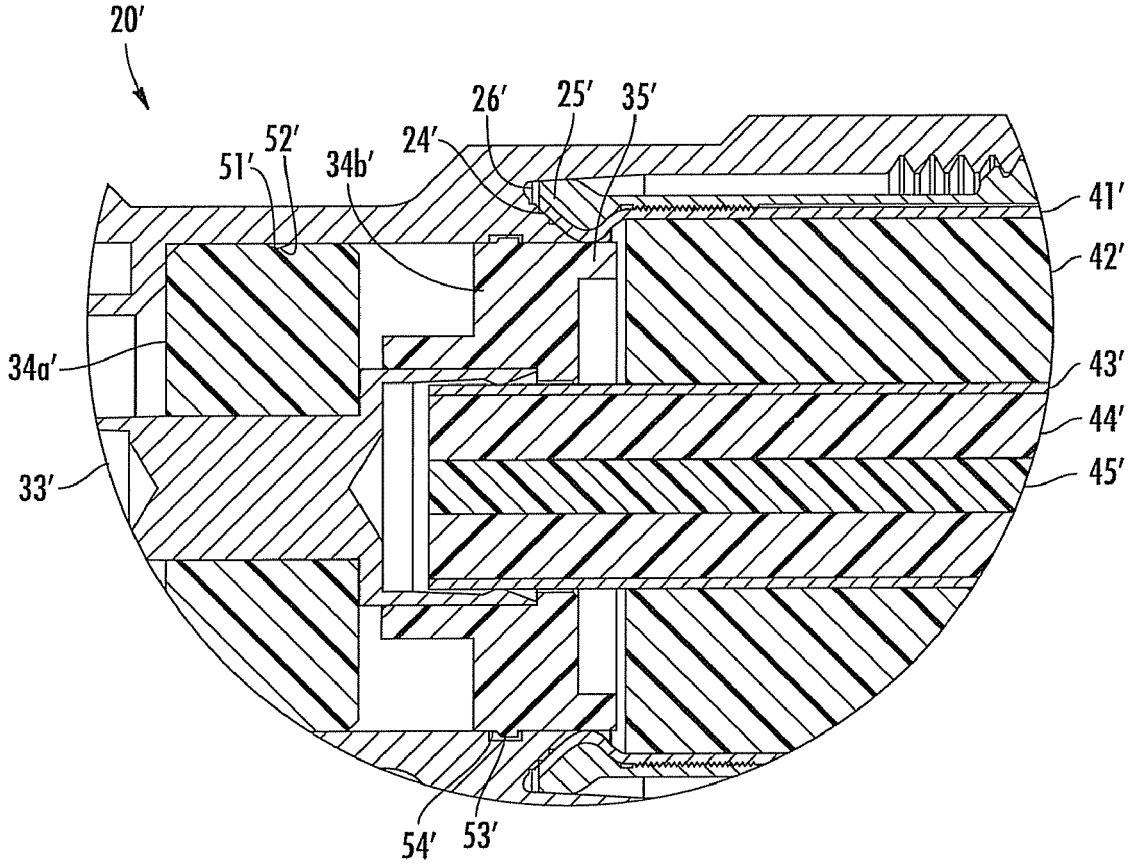
FIG. 13 is a greatly enlarged longitudinal cross-sectional view of the coaxial cable connector of FIG. 12.

Of course, the insulator member 34 may also be a two-piece unit in some applications. In the embodiment of the coaxial cable connector 20' shown in FIGS. 12-13, there are two insulator members 34*a*', 34*b*'. Also, as perhaps best shown in FIG. 14, the retaining projection 51' bites into the insulator member 34*a*', forming the depression 52' therein.

As shown in FIG. 15, the insulator member 34*b*' has a retaining projection 53' extending radially outwardly therefrom and the back nut 23' has an annular groove 54' defined on a radially inner surface thereof. The retaining projection 53' of the insulator member 34*b*' fits in the annular groove 54' and helps to positively locate and secure the insulator member 34*b*' in the connector housing 22'. Other elements not specifically mentioned are indicated with prime notation and are similar to the elements described above with reference to FIG. 1. Accordingly, those other elements require no further description herein.

In yet another embodiment of the coaxial cable connector 20", shown in FIGS. 16-19, each of the flexible fingers 25" has a bend 60" that deflects in response to longitudinal compression of that flexible finger 25" that deflects in response to longitudinal compression of that flexible finger. The flexible fingers 25" may of course deflect inwardly or outwardly at the bend 60". This bend advantageously allows the coaxial cable connector 25" to accommodate a wide variety of coaxial cables 40" having outer conductors 41" of different thicknesses by allowing the length of the flexible fingers 25" to self adjust. Other elements not specifically mentioned are indicated with double prime notation and are similar to the elements described above with reference to FIG. 1. Accordingly, those other elements require no further description herein.

Figure 23:
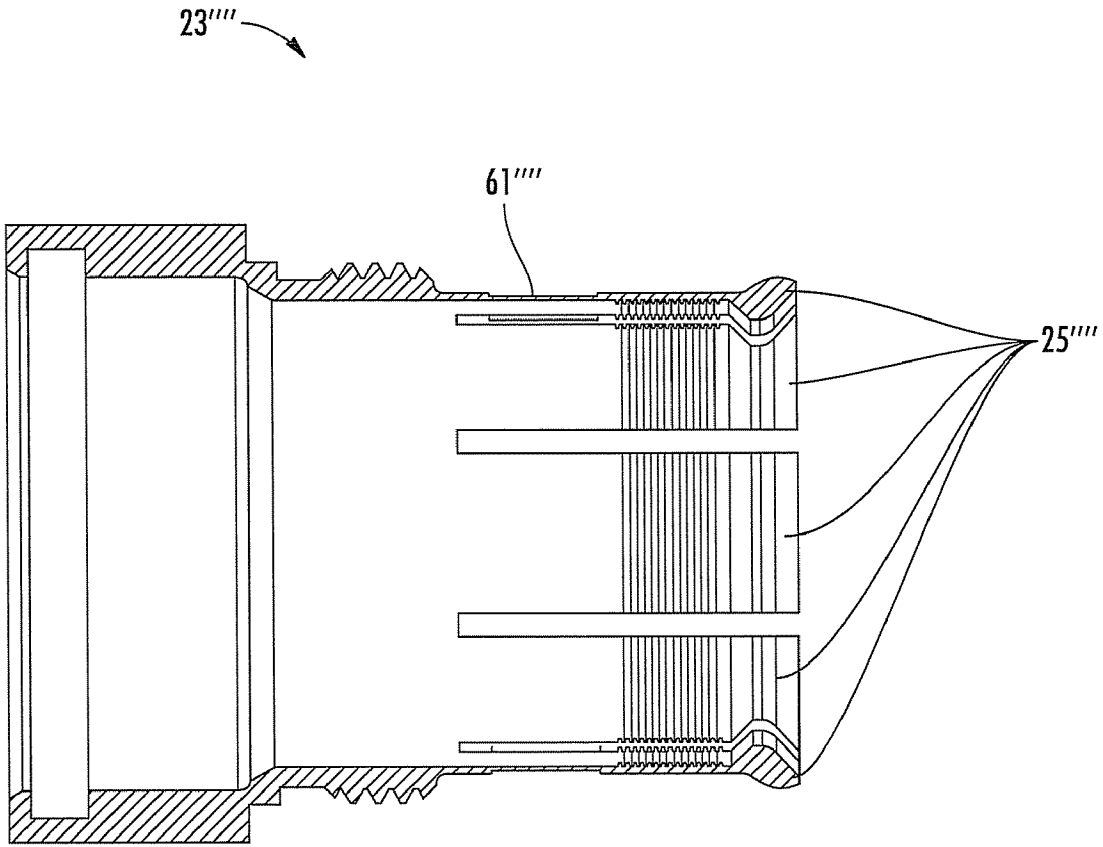
FIG. 23 is a side view of an alternative embodiment of the back nut of the present invention.
Figure 24:
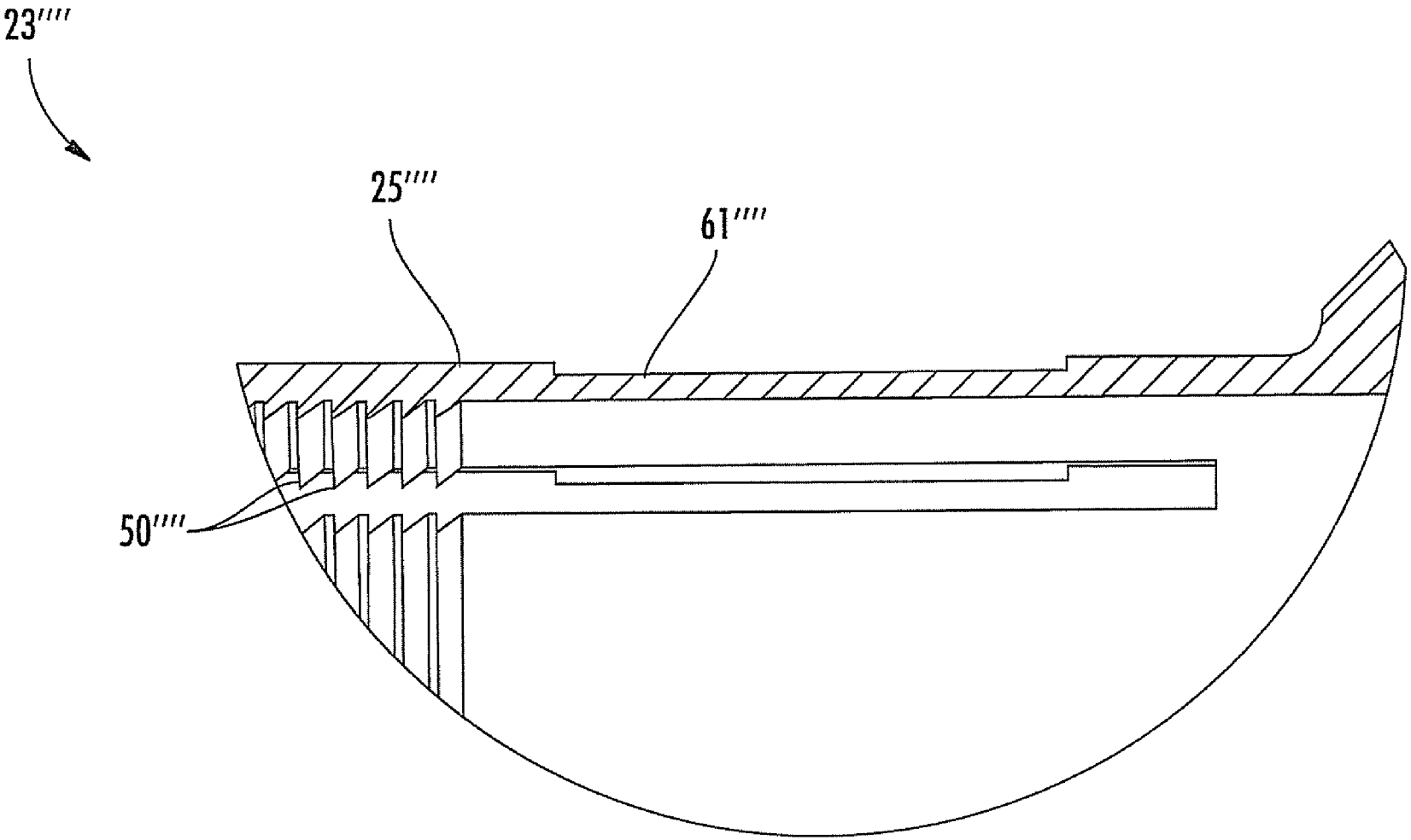
FIG. 24 is an enlarged view of a flexible finger of the back but of FIG. 23.
Figure 25:
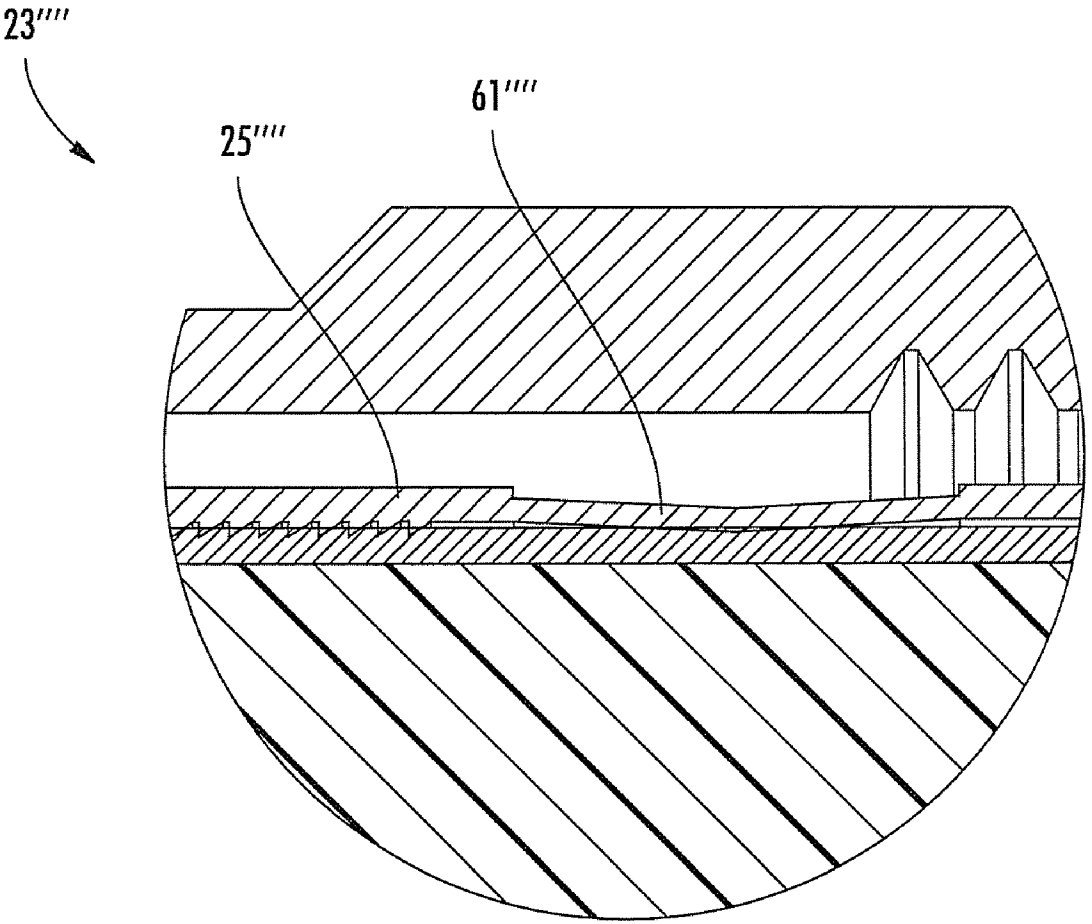
FIG. 25 is an enlarged longitudinal cross sectional view of the back nut of FIG. 23 showing a flexible finger.

In a further embodiment shown in FIGS. 23-25, the flexible fingers 25"" have a portion with a reduced thickness. The flexible fingers 25"" will deflect at this point in response to longitudinal compression of that flexible finger as the back nut 23"" and connector housing are screwed together. This advantageously allows the coaxial cable connector to accommodate a wide variety of coaxial cables having outer conductors of different thicknesses by allowing the length of the flexible fingers to self adjust.

With reference to FIG. 1, a method of making a coaxial cable connector 20 to be attached to a coaxial cable 40 comprising an inner conductor 43, an outer conductor 41, and a dielectric 42 therebetween is now described. The method comprises forming a connector housing 22 to have a ramp 24 to receive the outer conductor 41 thereagainst.

The method further includes forming a back nut 23 comprising a ring base 47 and a plurality of flexible fingers 25 extending forwardly therefrom to clamp against the outer conductor 41 opposite the ramp 24. The connector housing 22 and the back nut 23 are formed to have respective portions defining a positive stop 29 when fully engaged. A center contact 33 is formed to be coupled to the inner conductor. At least one insulator member 34 is formed to be positioned in the connector housing 22 for carrying the center contact 33 and comprises a radially outer support portion 35 to radially support the outer conductor 41 opposite the plurality of fingers 25.

Other details of such connectors 20 for coaxial cables 40 may be found in U.S. Pat. No. 7,785,144, CONNECTOR WITH POSITIVE STOP FOR COAXIAL CABLE AND ASSOCIATED METHODS, U.S. Pat. No. 7,731,529, CONNECTOR INCLUDING COMPRESSIBLE RING FOR COAXIAL CABLE AND ASSOCIATED METHODS, U.S. Pat. No. 7,632,143, CONNECTOR WITH POSITIVE STOP AND COMPRESSIBLE RING FOR COAXIAL CABLE AND ASSOCIATED METHODS, U.S. Pat. No. 7,635,283, CONNECTOR WITH RETAINING RING FOR COAXIAL CABLE AND ASSOCIATED METHODS, and U.S. Pat. Pub. No. 2010/016011, FLARING COAXIAL CABLE END PREPARATION TOOL AND ASSOCIATED METHODS, the entire disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A coaxial cable connector to be attached to a coaxial cable comprising an inner conductor, an outer conductor, and a dielectric therebetween, the connector comprising:

a connector housing defining a ramp to receive the outer conductor thereagainst;

a back nut comprising a ring base and a plurality of flexible fingers extending outwardly therefrom to clamp against the outer conductor opposite the ramp;

a center contact to be coupled to the inner conductor; and at least one insulator member in said connector housing for carrying said center contact and comprising a radially outer support portion to radially support the outer conductor opposite said plurality of fingers.

2. The coaxial cable connector of claim 1 wherein each of said plurality of flexible fingers has a bend therein.

3. The coaxial cable connector of claim 1 wherein each of said plurality of flexible fingers has a portion with a reduced thickness to deflect in response to longitudinal compression of that flexible finger.

4. The coaxial cable connector of claim 1 wherein at least one of said plurality of flexible fingers has a plurality of serrations extending from a surface thereof to engage the outer conductor.

5. The coaxial cable connector of claim 1 wherein said connector housing and said back nut include respective portions defining a positive stop when fully engaged.

6. The coaxial cable connector of claim 5 wherein said connector housing comprises an enlarged diameter tool engaging portion; wherein said back nut comprises a rearward end; and wherein the positive stop is defined by said enlarged diameter tool engaging portion and said rearward end.

7. The coaxial cable connector of claim 1 wherein said at least one insulator member comprises a first insulator member having a central opening therein to carry said center contact.

8. The coaxial cable connector of claim 7 wherein said at least one insulator member further comprises a second insulator member longitudinally spaced apart from, and positioned forwardly of, said first insulator member in the connector housing and also having a central opening therein to carry said center contact.

9. The coaxial cable connector of claim 1 wherein the ramp has a stair-stepped shape.

10. The coaxial cable connector of claim 1 wherein each of said plurality of flexible fingers has a knurled surface.

11. The coaxial cable connector of claim 1 further comprising at least one sealing ring carried within said back nut.

12. The coaxial cable connector of claim 1 wherein said at least one insulator member comprises a retaining projection extending therefrom; and wherein an annular groove is defined on a radially inner surface of said connector housing to receive said retaining projection.

13. The coaxial cable connector of claim 1 wherein said connector housing comprising a rearward portion threadingly received within a forward portion of said back nut.

14. A coaxial cable connector to be attached to a coaxial cable comprising an inner conductor, an outer conductor, and a dielectric therebetween, the connector comprising:

a connector housing defining a ramp to receive the outer conductor thereagainst and comprising an enlarged diameter tool engaging portion;

a back nut comprising a ring base, a plurality of flexible fingers extending forwardly therefrom to clamp against the outer conductor opposite the ramp, and a rearward end;

said enlarged diameter tool engaging portion and said rearward end defining a positive stop when fully engaged;

a center contact to be coupled to the inner conductor;

at least one insulator member in said connector housing for carrying said center contact and comprising a radially outer support portion to radially support the outer conductor opposite said plurality of fingers; and at least one sealing ring carried within said back nut.

15. The coaxial cable connector of claim 14 wherein each of said plurality of flexible fingers has a bend therein.

16. The coaxial cable connector of claim 14 wherein each of said plurality of flexible fingers has a portion with a reduced thickness to deflect in response to longitudinal compression of that flexible finger.

17. The coaxial cable connector of claim 14 wherein at least one of said plurality of flexible fingers has a plurality of serrations extending from a surface thereof to engage the outer conductor.

18. The coaxial cable connector of claim 14 wherein said at least one insulator member comprises a first insulator member having a central opening therein to carry said center contact.

19. The coaxial cable connector of claim 18 wherein said at least one insulator member further comprises a second insulator member longitudinally spaced apart from, and positioned forwardly of, said first insulator member in the connector housing and also having a central opening therein to carry said center contact.

20. The coaxial cable connector of claim 14 wherein said connector housing comprising a rearward portion threadingly received within a forward portion of said back nut.

21. A method of making a connector to be attached to a coaxial cable comprising an inner conductor, an outer conductor, and a dielectric therebetween, the method comprising:

forming a connector housing to have a ramp to receive the outer conductor thereagainst;

forming a back nut comprising a ring base and a plurality of flexible fingers extending forwardly therefrom to clamp against the outer conductor opposite the ramp;

forming a center contact to be coupled to the inner conductor; and forming at least one insulator member to be positioned in the connector housing for carrying the center contact and comprising a radially outer support portion to radially support the outer conductor opposite the plurality of fingers.

22. The method of claim 21 wherein each of the plurality of flexible fingers is formed to have a bend therein.

23. The method of claim 21 wherein each of the plurality of flexible fingers is formed to have a portion with a reduced thickness to deflect in response to longitudinal compression of that flexible finger.

24. The method of claim 21 wherein the connector housing is formed to have an enlarged diameter tool engaging portion; wherein the back nut is formed to have a rearward end; and wherein a positive stop is defined by the enlarged diameter tool engaging portion and the rearward end.

25. The method of claim 21 wherein at least one of the plurality of flexible fingers is formed to have a plurality of serrations extending from a surface thereof to engage the outer conductor.

26. The method of claim 21 wherein the at least one insulator member comprises a first insulator member having a central opening defined therein to carry the center contact.

27. The method of claim 26 wherein the at least one insulator member further comprises a second insulator member to be longitudinally spaced apart from, and positioned forwardly of, the first insulator member in the connector housing and also having a central opening defined therein to carry the center contact.

* * * * *

UNITED STATES PATENT AND TRADEMARK OFFICE

CERTIFICATE OF CORRECTION

PATENT NO. : 7,931,499 B2
APPLICATION NO. : 12/361241
DATED : April 26, 2011
INVENTOR(S) : Islam It is certified that error appears in the above-identified patent and that said Letters Patent is hereby corrected as shown below:

| | |
|---|---|
| Column 1, Line 45 | Delete: "in"<br>Insert: --an-- |
| Column 3, Line 16 | Delete: "comprises"<br>Insert: --comprise-- |
| Column 4, Line 52 | Delete: "but"<br>Insert: --nut-- |
| Column 5, Line 25 | Delete: "has stair-stepped"<br>Insert: --has a stair-stepped-- |
| Column 6, Line 58 | Delete: "is" |
| Column 7, Line 10 | Delete: "secure located"<br>Insert: --securely locate-- |
| Column 9, Line 16 | Delete: "comprising"<br>Insert: --comprises-- |
| Column 10, Line 8 | Delete: "comprising"<br>Insert: --comprises-- |

Signed and Sealed this
Sixth Day of September, 2011

David J. Kappos

David J. Kappos
*Director of the United States Patent and Trademark Office*